United States Patent [19]

Segura

[11] 4,119,268

[45] Oct. 10, 1978

[54] BAG HAVING A HANDLE SECURED THERETO

[75] Inventor: Daniel A. Segura, Des Moines, Iowa

[73] Assignee: Great Plains Bag Corp., Des Moines, Iowa

[21] Appl. No.: 799,366

[22] Filed: May 23, 1977

Related U.S. Application Data

[63] Continuation of Ser. No. 670,116, Mar. 25, 1976, abandoned.

[51] Int. Cl.[2] ..... B65D 33/06

[52] U.S. Cl. ..... 229/54 R; 229/52 A

[58] Field of Search ..... 229/52 A, 54 R, 54 C; 150/12; 206/200, 162; 224/45 BA, 45 H, 45 AB

[56] References Cited

U.S. PATENT DOCUMENTS

| | | | |
|---|---|---|---|
| 1,492,100 | 4/1924 | Krueger | 229/52 A |
| 1,524,399 | 1/1925 | Krueger | 229/52 A |
| 1,733,219 | 10/1929 | Duvall | 229/52 A X |
| 2,011,407 | 8/1935 | Hirsch | 229/54 C |
| 2,486,178 | 10/1949 | Kuehlhorn | 229/52 A X |
| 2,722,368 | 11/1955 | Gottsegen | 229/52 R |

FOREIGN PATENT DOCUMENTS

| | | | |
|---|---|---|---|
| 1,396,290 | 6/1975 | United Kingdom | 229/54 R |

*Primary Examiner*—Stephen P. Garbe

*Attorney, Agent, or Firm*—Zarley, McKee, Thomte, Voorhees & Sease

[57] ABSTRACT

A bag comprising a front wall, a back wall and opposite end walls forming an enclosed container. A handle is secured to one of the end walls. The handle is comprised of an upstanding folded portion having oppositely extending flat base portions which extend laterally outwardly from the lower end thereof. The flat base portions are secured to a flat member which is secured to the end wall. The upstanding portion has a hand receiving slip formed therein which is comprised of a generally horizontal slit which has its opposite ends terminating in upwardly and inwardly curved portions. The curved slit portions terminate in tightly curled portions to minimize tearing of the handle and to permit the handle to withstand greater stress.

10 Claims, 11 Drawing Figures

BAG HAVING A HANDLE SECURED THERETO

This is a continuation, of application Ser. No. 670,116 filed Mar. 25, 1976 now abandoned.

BACKGROUND OF THE INVENTION

This invention relates to a bag and more particularly to a plastic bag having a carrying handle secured to one end thereof.

Plastic bags are widely used as containers for fertilizer, etc. Attempts have been made to provide carrying handles for the bags but it has been found that it is difficult to design a handle which will not tear.

Therefore, it is a principal object of the invention to provide a bag having an improved carrying handle secured thereto.

A further object of the invention is to provide a bag having a carrying handle attached thereto which is designed to withstand greater stresses than the devices heretofore available.

A still further object of the invention is to provide a bag having a carrying handle attached thereto wherein means is provided for preventing the handle from tearing.

A still further object of the invention is to provide a carrying handle for a bag which is easy to use, durable in use and refined in appearance.

These and other objects will be apparent to those skilled in the art.

DESCRIPTION OF THE PREFERRED EMBODIMENT

Figure 1:
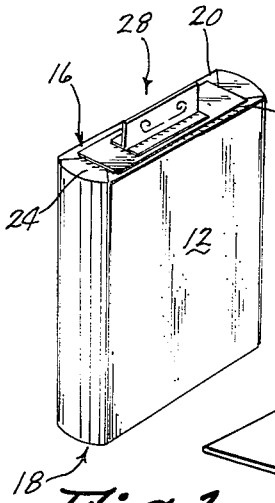
FIG. 1 is a perspective view of the bag of this invention.

The bag of this invention is referred to generally by the reference numeral 10 and comprises a front wall 12, back wall 14, and opposite end walls or closures 16 and 18. Bag 10 is comprised of a single ply or multi-ply plastic or paper material.

End wall or closure 16 is comprised of side flaps 20 and 22 which are folded inwardly towards one another and which are secured together in an overlapped condition by suitable adhesive or the like. Closure 16 also includes end flaps 24 and 26 which are foldably inwardly beneath the side flaps 20 and 22 at the opposite ends thereof.

Figure 2:
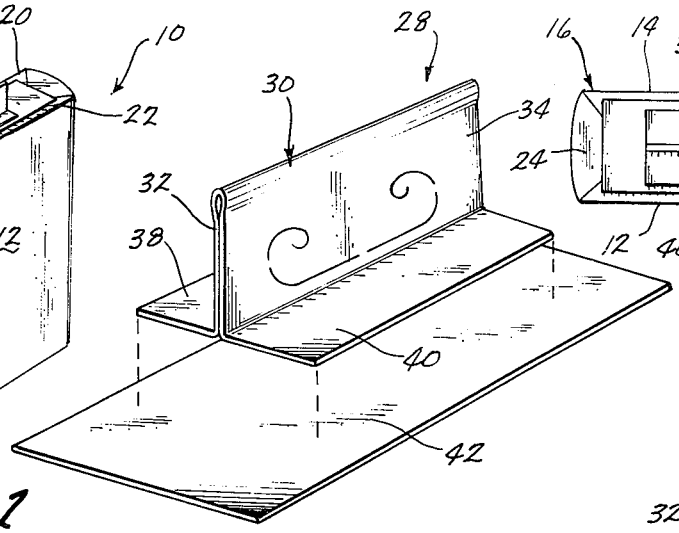
FIG. 2 is an exploded perspective view of the carrying handle.
Figure 3:
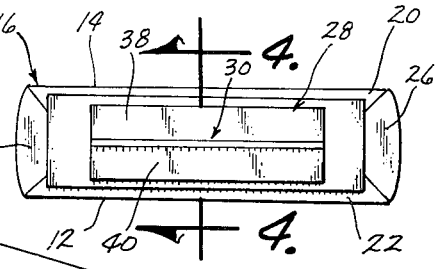
FIG. 3 is a top view of the bag having the carrying handle mounted thereon.
Figure 4:
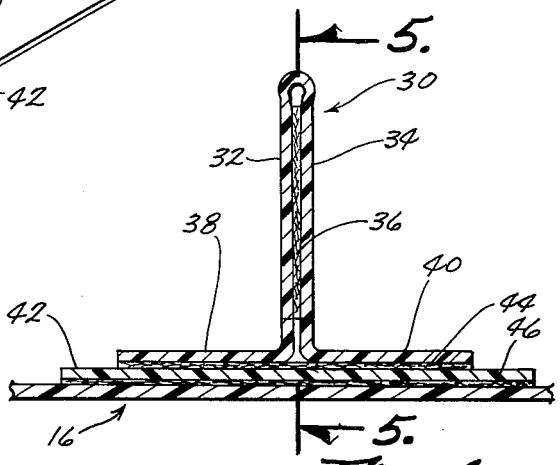
FIG. 4 is an enlarged sectional view seen on lines 4—4 of FIG. 3.
Figure 5:
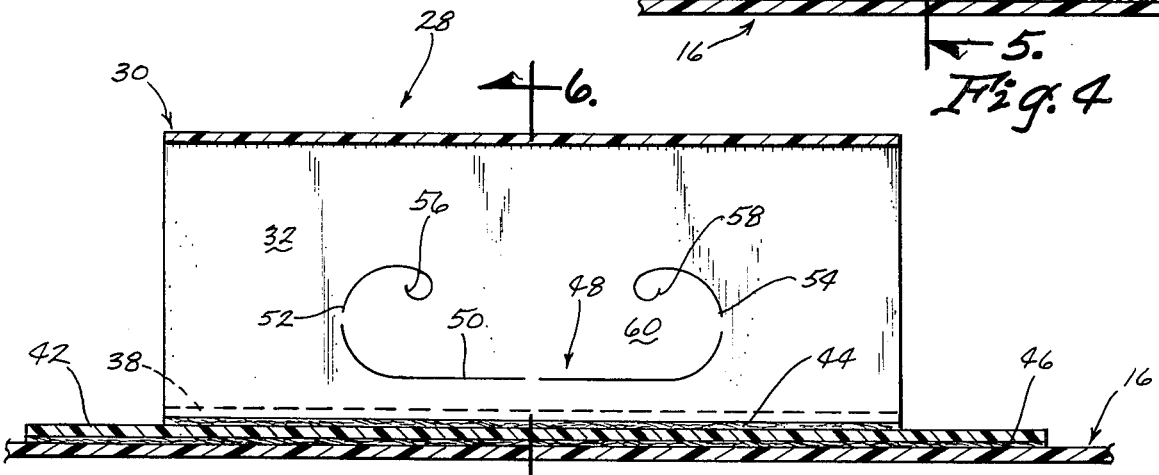
FIG. 5 is a sectional view seen on lines 5—5 of FIG. 4.

The carrying handle of this invention is referred to generally by the reference numeral 28 and is best seen in the exploded perspective view of FIG. 2. Carrying handle 28 is folded upon itself as illustrated in FIG. 2 to create the upstanding portion 30 generally comprised of upstanding members 32 and 34 which are secured together by suitable adhesive referred to generally by the reference numeral 36. A pair of laterally extending base portions 38 and 40 extend outwardly from the lower ends of members 32 and 34 respectively. Base portions 38 and 40 are secured to a rectangular flat member 42 by means of a suitable adhesive or the like referred to generally by the reference numeral 44. As seen in FIG. 2, member 42 has a substantially greater area than base portions 38 and 40. Member 42 is secured to end wall 16 as illustrated in FIGS. 4 and 5 by suitable means such as adhesive 46. Member 42 not only provides a means for connecting base portions 38 and 40 to the bag but also causes forces from pulling or carrying to be distributed over a wider portion of the upper end of the bag. Additionally, the attachment of the member 42 to the closure 16 also aids in closing the upper end of the bag.

Handle 28 is comprised of a plastic material and is provided with a hand receiving slit formed in members 32 and 34 which is referred to collectively by the reference numeral 48. Slit 48 generally comprises a horizontally disposed portion 50, the opposite ends of which terminate in upwardly and inwardly curved or arcuate portions 52 and 54, respectively. Portions 52 and 54 terminate in tightly curled portions 56 and 58 which may also be referred to as curlicues.

Figure 6:
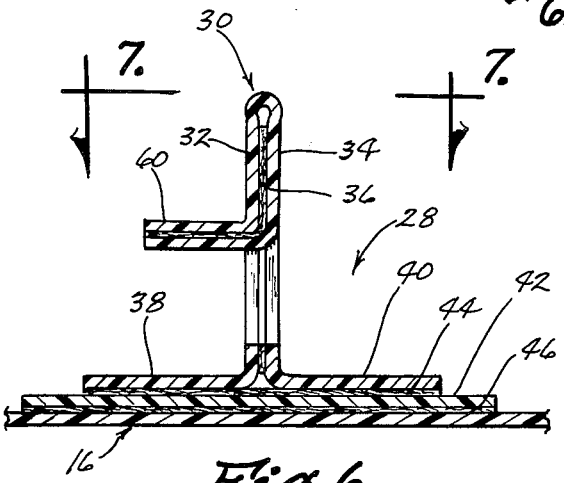
FIG. 6 is a sectional view as seen on lines 6—6 of FIG. 5 with the handle having been deformed to accommodate a person's hand.
Figure 7:
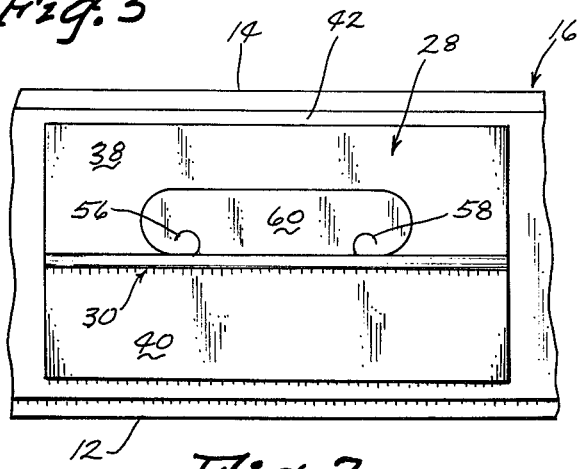
FIG. 7 is a top view as seen on lines 7—7 of FIG. 6.

In use, the person desiring to carry the bag 10 simply deflects the flap portion 60 laterally with respect to the upstanding portion 30 as best seen in FIGS. 6 and 7 to accommodate the fingers of the person's hand. The curlicues 56 and 58 are extremely important in that they minimize tearing at the ends of the slit 48 and permit the handle to withstand greater stresses than that which is ordinarily possible. The adhesive 36 between the members 32 and 34 also increases the strength of the handle to insure that the handle will not tear when being used.

Of critical importance to the present invention is the shape of the curlicue ends 56, 58 of slit 48. It should be noted that the curlicues are spiral in shape, having a reduced radius of curvature. Furthermore, these curlicues 56, 58 extend in a spiral path which exceeds 360° from the direction of horizontally disposed portion 50. The curlicue ends should turn more than 180° from the direction of horizontal portion 50, and it is preferred that these curlicue ends turn more than 270°. By so doing, the curlicues protect against further tearing at the terminal ends of the slit 48 when the bag is lifted. As can be seen in FIG. 7, the flap 60 folds in such a manner that the ends of curlicues 56, 58 are not exposed to stress. This greatly enhances the ability of the handle to withstand heavier weights within the bag without tearing.

Figure 8:
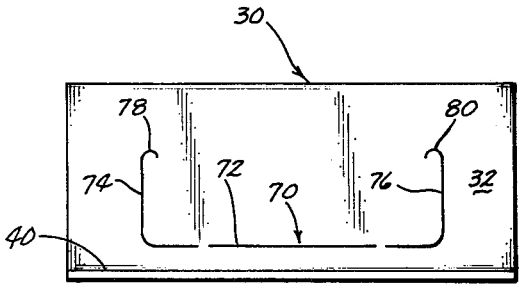
FIGS. 8–10 are elevational views of three modified handles for use with the present invention.

FIG. 8 illustrates a modified handle slit 70 which is comprised of a straight horizontal lower portion 72 having at its opposite ends two vertically extending straight portions 74, 76. The upper ends of portions 74, 76 terminate in arcuate curls 78, 80 which turn slightly more than 180° with respect to lower horizontal portion 72 so as to relieve the terminal ends of slit 70 from tearing forces when the handle is folded for carrying.

Figure 9:
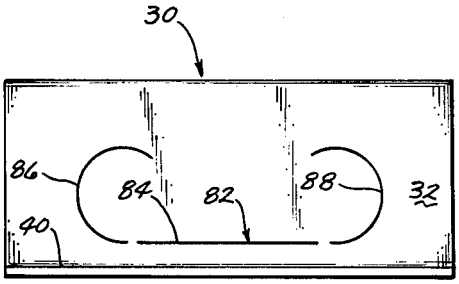

FIG. 9 illustrates a further modified slit 82 which includes a lower horizontal portion 84 having at its opposite ends circular portions 86, 88 which extend upwardly and terminate pointing in a direction slightly more than 180° with respect to lower horizontal portion 84. The arc of curvature of end portions 86, 88 does not change as is the case with the terminal ends of slit 48 (FIG. 5) and slit 70 (FIG. 8).

Figure 10:
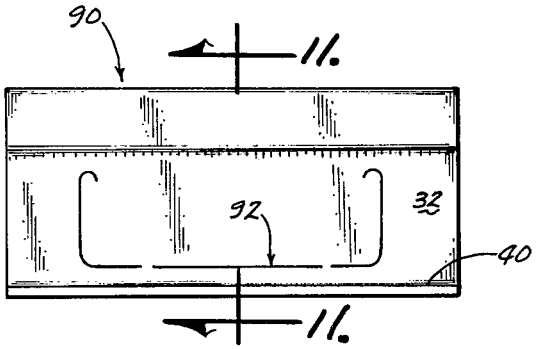
Figure 11:
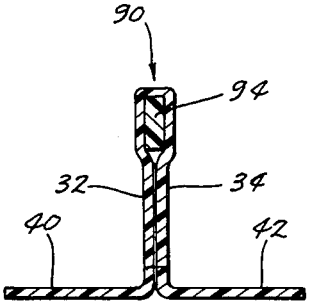
FIG. 11 is a sectional view taken along line 11—11 of FIG. 10.

FIG. 10 illustrates a modified handle 90 which includes a slit 92 identical to slit 70 shown in FIG. 8. However, the particular configuration of slit 92 may be varied according to the forms shown in FIGS. 5, 8 and 9. Interposed between members 32, 34 of handle 90 at the upper edges thereof is a reinforcing member 94 (FIG. 11) which is constructed of a rigid plastic or other rigid material. Reinforcing member 90 provides reinforcement against bending of the upper edges of members 32, 34 when the bag is being carried by means of slit 92. Use of this reinforcing member permits the handle to be used with a much heavier container without deformation of the handle during use.

Thus, it can be seen that the device accomplishes at lease all of its stated objectives.

What is claimed is:

1. A bag comprising:

a front wall, a back wall and opposite end walls forming an enclosed container, said end walls comprising at least two side flaps and at least two end flaps which are folded in overlapping relation to form an end closure for said bag;

a handle operatively secured to one of said end walls, said handle comprising a sheet member folded over upon itself to form a two ply thickness central portion and two diverging laterally extending single ply thickness flaps extending from the lower edge of said central portion in a plane approximately perpendicular to the plane of said central portion;

a flat sheet member secured to one of said end walls and overlapping at least portions of said side and end flaps;

said diverging flaps being in facing engagement with said flat sheet member and operatively secured thereto;

a hand receiving slit cut through said central two ply thickness portion, said slit having a lower horizontal portion with opposite ends extending upwardly and terminating in curlicue ends, said curlicue ends extending in a path which changes directions more than 180° from the direction of said horizontal portion;

said slit forming a flap portion of two ply thickness;

a horizontal fold line on said central portion for said flap portion, said fold line being approximately parallel with said horizontal portion of said slit and approximately tangential to said slit at points spaced from the opposite terminal ends of said slit;

said flap portion being deflected in a lateral direction about said fold line.

2. The bag according to claim 1 wherein said bag, said sheet member, and said handle are formed of plastic material.

3. The bag according to claim 1 wherein said curlicue ends extend in a path which changes directions at least 270° from the direction of said horizontal portion.

4. A bag according to claim 1 wherein said curlicue ends extend in a path which changes directions at least 360° from the direction of said horizontal portion.

5. A bag according to claim 1 wherein said opposite ends of said lower horizontal portion curve upwardly and said curlicue ends extend in a spiral path which reduces in radius of curvature.

6. A bag according to claim 1 wherein said opposite ends of said lower horizontal portion extend upwardly in a straight line to said curlicue ends.

7. A bag according to claim 1 wherein said opposite ends of said lower horizontal portion curve upwardly in a constant arc of curvature, said curlicue ends forming a continuation of said arc and continuing with a constant arc of curvature.

8. A bag according to claim 1 wherein an elongated horizontal reinforcing member is interposed between the portions of said sheet member forming said two ply thickness central portion, said reinforcing member being positioned above said curlicue ends.

9. A bag according to claim 1 wherein each ply of said two ply thickness central portion of said handle is adhesively bonded to the other ply of said central portion.

10. The bag according to claim 1 wherein said flat sheet member has a surface area greater than the combined surface areas of said diverging flaps.

* * * * *